US005989084A

United States Patent [19]

Tsunoda et al.

[11] Patent Number: 5,989,084

[45] Date of Patent: Nov. 23, 1999

[54] OUTBOARD MARINE ENGINE HAVING A VERTICAL CRANKSHAFT

[75] Inventors: Masaki Tsunoda; Hiroki Tawa, both of Wako, Japan

[73] Assignee: Honda Giken Kogyo Kabushiki Kaisha, Japan

[21] Appl. No.: 09/016,087

[22] Filed: Jan. 30, 1998

[30] Foreign Application Priority Data

Feb. 3, 1997 [JP] Japan ..... 9-020629

[51] Int. Cl.[6] ..... B63H 1/14; F02F 7/00

[52] U.S. Cl. ..... 440/49; 440/900; 123/195 A; 123/195 C

[58] Field of Search ..... 440/76, 84, 900; 123/195 A, 195 C, 195 E, 195 P

[56] References Cited

U.S. PATENT DOCUMENTS

| | | | |
|---|---|---|---|
| 4,666,122 | 5/1987 | Goodard | 248/666 |
| 4,832,666 | 5/1989 | Henderson | 474/135 |
| 5,112,281 | 5/1992 | Minato et al. | 474/84 |
| 5,125,376 | 6/1992 | Williams et al. | 123/195 |
| 5,425,336 | 6/1995 | Nakayama | 123/198 |
| 5,755,606 | 5/1998 | Takahashi et al. | 440/84 |

FOREIGN PATENT DOCUMENTS 6-33790 6/1994 Japan .

*Primary Examiner*—Sherman Basinger
*Assistant Examiner*—Patrick Muldoon
*Attorney, Agent, or Firm*—Skjerven, Morrill, MacPherson, Franklin & Friel LLP

[57] ABSTRACT

In an outboard marine engine having a vertically oriented crankshaft, a bracket for supporting an AC generator is provided with a pair of cantilever arms for supporting a pivoted portion and a fixed portion of the AC generator, and a belt cover for the engine is partly supported by extensions of these cantilever arms. The bracket is typically mounted to a portion of the crankcase defining a corner between a vertical end surface and a horizontal top surface. By thus securing the belt cover to the bracket for securing the AC generator, it is possible to firmly support the belt cover and prevent undesirable rattling or vibration of the belt cover because the bracket is given with a sufficient rigidity from the need to firmly support the electric generator. Therefore, the firm support of the belt cover can be accomplished without any substantial cost increase.

8 Claims, 5 Drawing Sheets

OUTBOARD MARINE ENGINE HAVING A VERTICAL CRANKSHAFT

TECHNICAL FIELD

The present invention relates to an internal combustion engine having a vertically oriented crankshaft, and in particular to a vertical crankshaft engine suitable for use as outboard marine engines.

BACKGROUND OF THE INVENTION

In an engine for a road vehicle, although the timing belt passed around a crank pulley and a cam pulley is entirely covered by a belt cover, the belts for auxiliary equipment such as an AC generator and a compressor for an air conditioner are normally exposed. However, in an outboard marine engine, it is desirable to cover the AC generator and the belt for transmitting power to the AC generator to protect them from moisture, and, for instance, Japanese patent laid open publication (kokai) No. 6-33790 discloses an arrangement for covering an AC generator.

The AC generator is typically placed on one side of the cylinder block of the engine at some distance from the engine. Therefore, the belt cover for covering the power transmission belt for the AC generator inevitably hangs over from the engine main body. To prevent such an overhanging belt cover from rattling or vibrating, it is necessary for the belt cover to have a sufficient rigidity. This contributed to an increase in the manufacturing cost.

BRIEF SUMMARY OF THE INVENTION

In view of such problems of the prior art, a primary object of the present invention is to provide a vertical crankshaft engine suitable for use as an outboard marine engine which allows the belt cover for an AC generator to have a high rigidity without increasing the manufacturing cost.

A second object of the present invention is to provide an outboard marine engine having a vertical crankshaft which allows the belt cover for an AC generator to have a high rigidity while simplifying the assembly process.

According to the present invention, these and other objects can be accomplished by providing an outboard marine engine, comprising: an engine main body including a cylinder block, a crankcase, and a cylinder head; a crankshaft extending out of one end of the engine main body in a vertical direction and carrying a drive pulley at a free end thereof; an electric generator attached to the engine main body and having an input shaft extending in parallel with the crankshaft and carrying a driven pulley at a free end thereof projecting from the one end of the engine main body; a belt passed around the drive and driven pulleys for transmission of power from the drive pulley to the driven pulley; and a belt cover covering at least part of the belt; wherein the electric generator is mounted to the engine main body via a bracket, and the belt cover is at least partly secured to an extension of the bracket.

By thus securing the belt cover to the bracket for securing the electric generator, it is possible to firmly support the belt cover and prevent undesirable rattling or vibration of the belt cover because the bracket is given with a sufficient rigidity from the need to firmly support the electric generator. Therefore, the firm support of the belt cover can be accomplished without any substantial cost increase. In particular, when the bracket comprises first and second cantilever arms extending away from the engine main body for securing a pivoted portion and a fixed portion of the electric generator, and the belt cover is secured to extensions of the cantilever arms, the belt cover can be supported at portions which are significantly hanging over from the engine main body, and a particularly firm support of the belt cover becomes possible.

Such cantilever arms are commonly used for supporting an electric power generator such as an AC generator. The first cantilever arm typically comprises vertically bifurcated end portions between which the pivoted portion of the electric generator is interposed in such a manner that the electric generator may be pivoted with respect to the engine main body via a bolt passed vertically through the bifurcated end portions of the first cantilever arm and the pivoted portion of the AC generator. The second cantilever arm typically comprises an elongated slot defining an arc centered around the bolt passed vertically through the bifurcated end portions of the first cantilever arm so as to allow adjustment of the tension of the belt by moving the fixed portion along the second cantilever arm, and selectively securing the fixed portion with respect to the second arm at a desired tension of the belt.

According to a particularly advantageous arrangement, the bracket is attached to a part of the crankcase defining a corner between a vertical surface and a horizontal surface, and the bracket is secured to the crankcase by at least one vertically oriented threaded bolts passed through the bracket and into the horizontal surface of the crankcase, and at least one horizontal threaded bolt passed through the bracket and into the vertical surface of the crankcase. Typically, the vertical surface of the crankcase consists of an end surface of the engine main body, and the horizontal surface of the crankcase consists of an upper surface of the engine main body.

BRIEF DESCRIPTION OF THE DRAWINGS

Now the present invention is described in the following with reference to the appended drawings, in which:

FIG. 3 is an enlarged fragmentary sectional plan view of a part of FIG. 2;

DETAILED DESCRIPTION OF THE PREFERRED EMBODIMENTS

Figure 1:
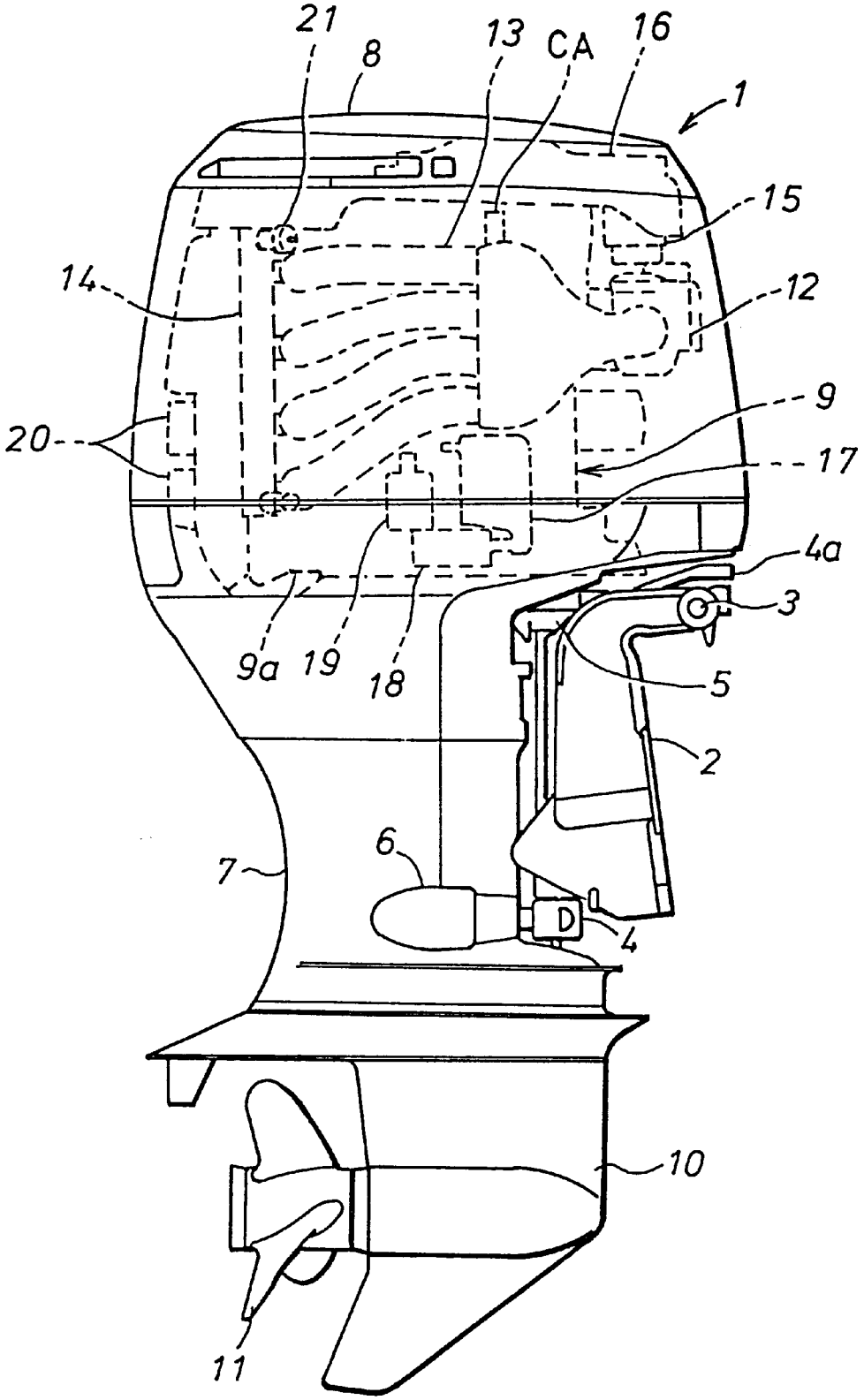
FIG. 1 is a see-through side view of an outboard marine engine assembly embodying the present invention.
Figure 2:
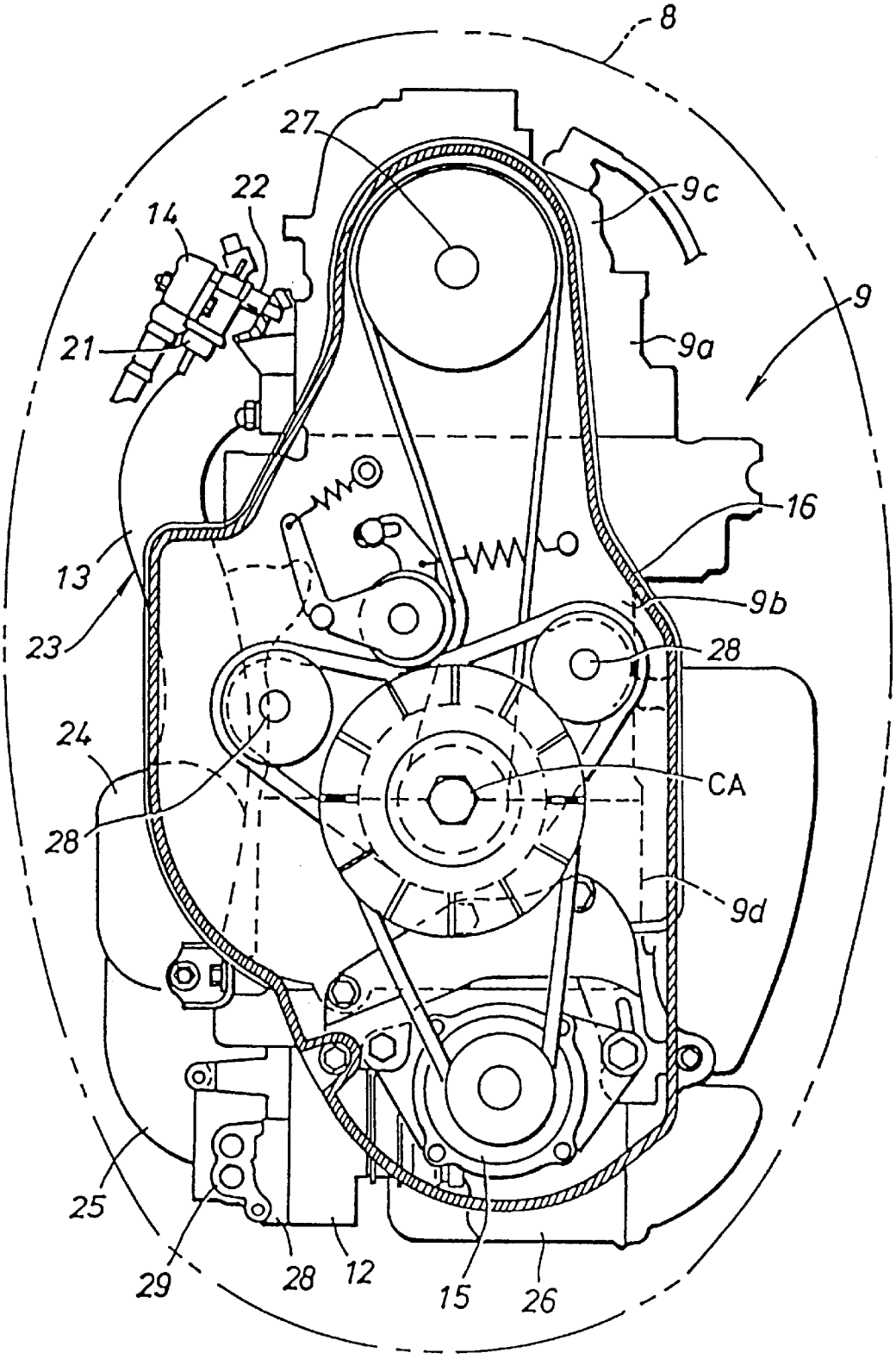
FIG. 2 is a sectional plan view of the outboard marine engine.
Figure 9:
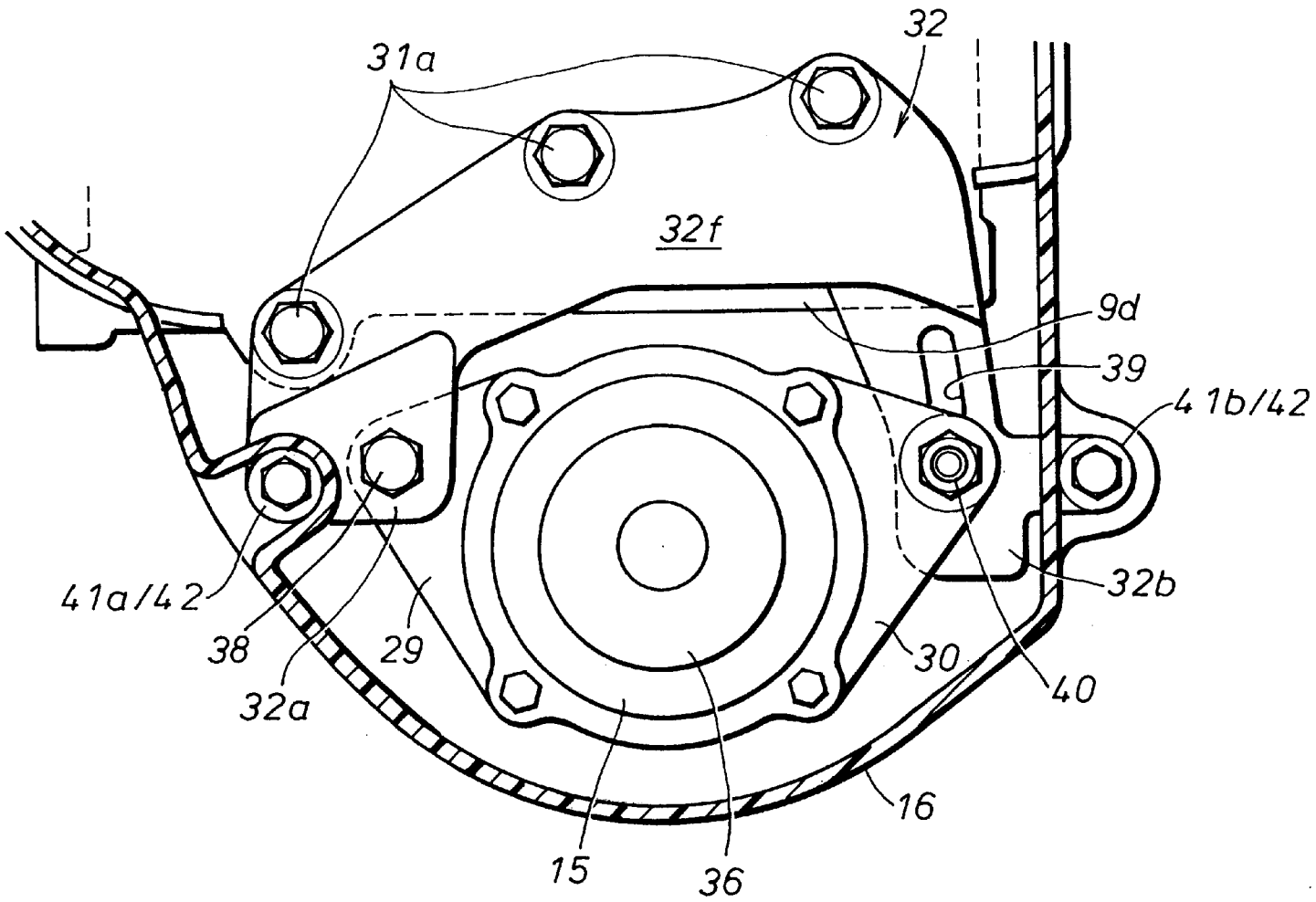

FIGS. 1 and 2 generally illustrate an outboard marine engine assembly 1 embodying the present invention. This outboard marine engine assembly 1 is attached to a stern board of a boat (not shown in the drawing) via a stern bracket 2 equipped with clamping means. To the stern bracket 2 is connected a swivel case 4 so as to be tiltable via a tilt shaft 3 extending laterally and horizontally with respect to the boat. The swivel case 4 is provided with a vertical swivel shaft (not shown in the drawing) to allow the engine main body to be swung laterally for steering the boat. Upper and lower mount arms 5 and 6 extend rearwardly from the swivel case 4, and an extension case 7 accommodating a propeller shaft (not shown in the drawing) is supported by free ends of these mount arms 5 and 6.

A steering arm 4*a* integrally formed with the swivel shaft extends in the forward direction so that the steering of the boat can be accomplished by moving the steering arm 4*a* in either lateral direction via the lateral swinging motion of the engine main body. An engine 9 is placed above the extension case 7, and is generally covered by an engine cover 8. A gear case 10 supporting a screw propeller 11 is attached to a lower end of the extension case 7.

The engine 9 consists of a vertical crankshaft engine having a crankshaft CA which is oriented vertically in use, and, in this particular embodiment, consists of a water-cooled four-cylinder, four-stroke engine. As shown in FIG. 2, the engine 9 comprises a cylinder block 9*b*, a cylinder head 9*a* attached to one end of the cylinder block 9*b* so as to define combustion chambers, a head cover 9*c* covering the valve actuating mechanism provided in the cylinder head 9*a*, and a crankcase 9*d* attached to the crankshaft end of the cylinder block 9*b*.

A throttle body 12 is placed on the front end of the assembly, and somewhat offset to the starboard side. A manifold assembly 23 extends from a starboard side of the cylinder head 9*a* in a rear end portion of the assembly 1 to the throttle body 12. The manifold assembly 23 comprises four intake tubes 13 extending from the cylinder head 9*a* and a surge tank 24 which joins the four intake tubes 23 and is connected to the throttle body 12. The throttle body 12 has its central axial line extending laterally at the front end of the engine, and the inlet end of the throttle body 12 is connected to a suction chamber 26 which has an air inlet opening directed downward. Thus, the throttle body 12 and the suction chamber 26 are placed so as to oppose the front end of the crankcase 9*d*.

A fuel supply rail 14 extends vertically near the area of interconnection between the intake tubes 13 and the cylinder head 9*a*, and supports fuel injectors 22 provided in the downstream ends of the intake tubes 13, and distribute fuel to these fuel injectors 22.

The lower ones of the intake tubes 13 are curved upward as they extend away from the cylinder head 9*a*. A space is therefore defined under the intake tubes 13 on the starboard side of the engine, and this space accommodates a sub-tank 17, a high pressure fuel pump 18 and a fuel filter 19.

The fuel supplied from a main tank not shown in the drawing is first delivered by a low pressure pump 20 mounted on the rear end of the engine 9 to the sub-tank 17, and via the high pressure pump 18 and the fuel filter 19, forwarded to an end (a lower end) of the fuel rail 14 to be distributed to the respective fuel injectors. The fuel pressure at the fuel injectors is regulated by a regulator 21 mounted on an upper end of the fuel rail 14.

The upper end of the engine 9 is covered by a belt cover 16 for covering a power transmission belt mechanism for transmitting power from the crankshaft CA to an AC generator 15, a camshaft 27, and a pair of balancer hafts 28.

Figure 4:
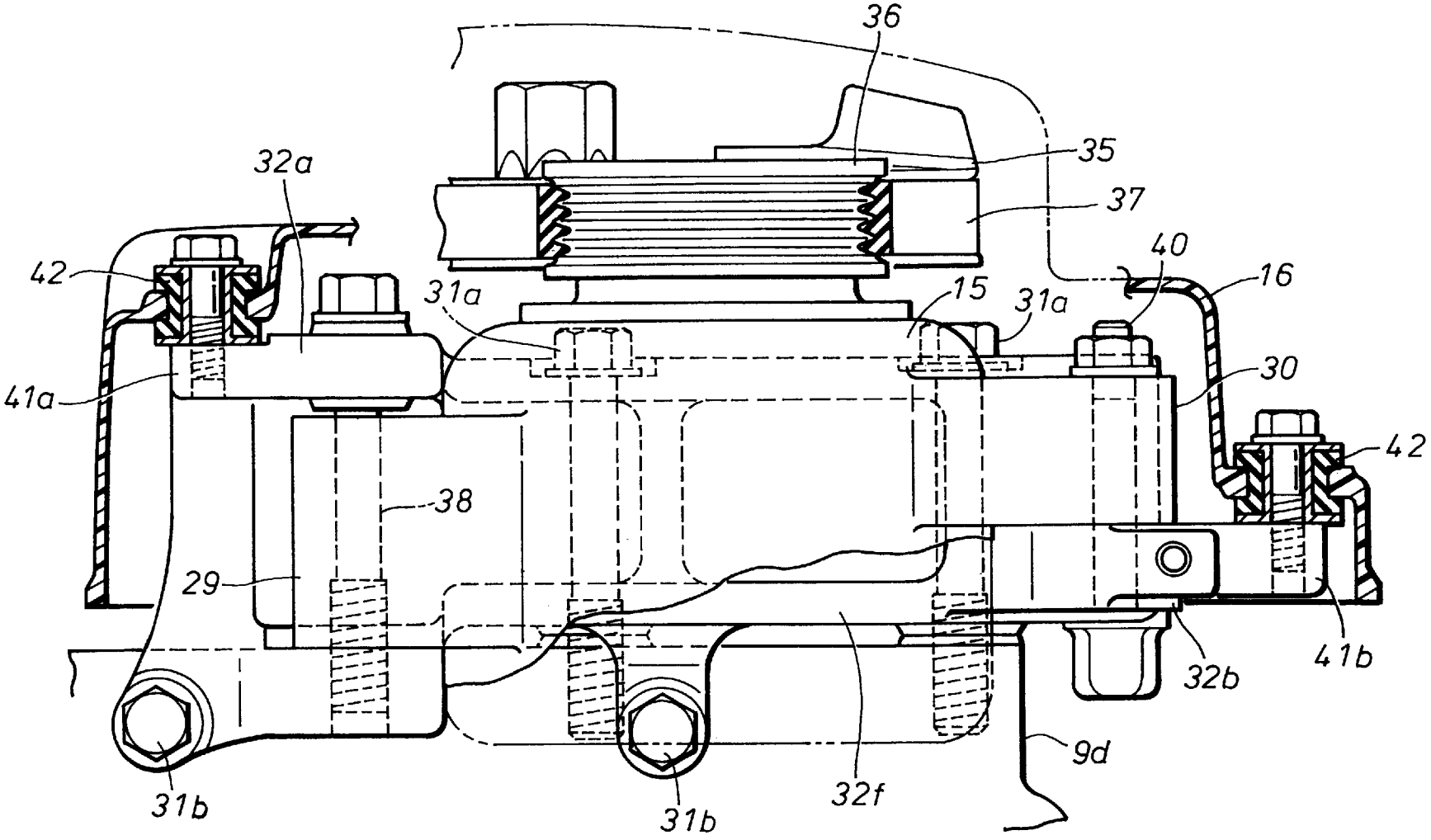
FIG. 4 is an enlarged fragmentary sectional end view of a part of FIG. 2.
Figure 5:
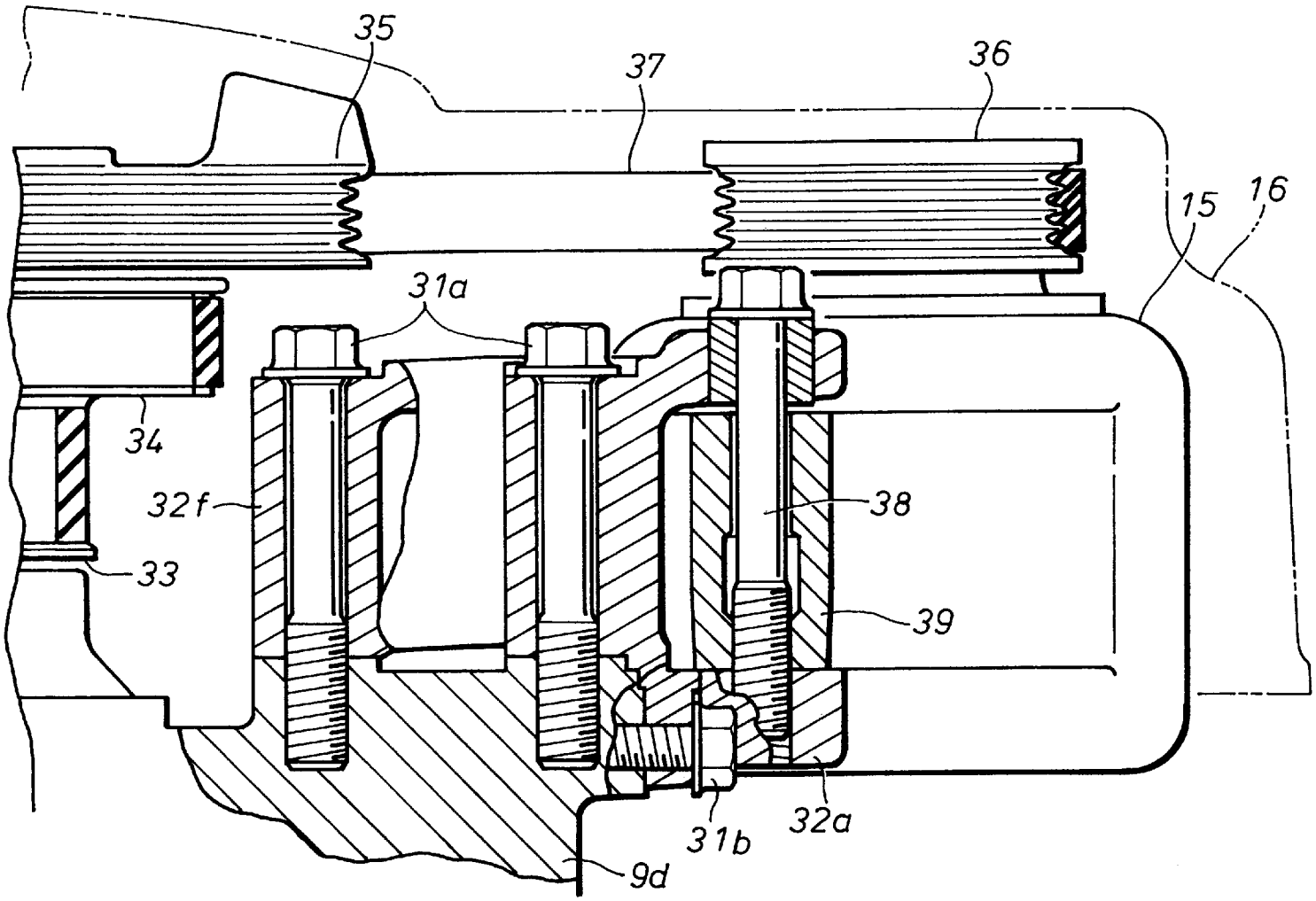
FIG. 5 is an enlarged fragmentary sectional side view of a part of FIG. 2.

FIGS. 3 to 5 show the arrangement for mounting the AC generator 15. The AC generator 15 consists of a known type, and comprises a pivot portion 29 projecting radially from the casing, and a fixed portion 30 at a diagonally opposed position of the casing with respect to the pivot portion 29. A bracket 32 is attached to a corner portion of the crankcase 9*d* between a horizontal upper surface and a vertical end surface thereof by three threaded bolts 31*a* passed vertically into corresponding threaded bores formed in the upper surface of the crankcase 9*d*, and two threaded bolts 31*b* passed horizontally into corresponding threaded bores formed in the end surface of the crankcase 9*d*.

The bracket 32 is, for instance, made of cast aluminum alloy so as to have sufficient rigidity, and comprises a main portion 32*f* which is secured to the crankcase 9*d* by the five threaded bolts 31*a* and 31*b* as mentioned above, and a pair of cantilever arms 32*a* and 32*b* extending away from the crankcase 9*d* from two side ends of the main portion 32*f*. The bracket 32 serves also as a spacer for allowing the AC generator 15 to be placed in a relatively raised position relative to the upper surface of the crankcase 19*d* and to align a driven pulley 36 attached to an input shaft of the AC generator 15 with a drive pulley 35, which is secured to the crankshaft CA along with a drive pulley for the camshaft and a drive pulley 34 for the balancer shafts, so that a belt 37 may be properly passed around both the drive pulley 35 and the driven pulley 36. The belt 37 is omitted from illustration in FIG. 3.

One of the cantilever arms 32*a* is vertically bifurcated into two parts between which the pivot portion 29 of the AC generator 15 is pivotally supported by a threaded bolt 38 passed vertically through the bifurcated ends of the cantilever arm 32*a* and the pivot portion 29. The other cantilever arm 32*b* abuts the lower surface of the fixed portion 30 of the AC generator 15 from below, and is provided with an elongated slot 39 which extends along an arc centered around the threaded bolt 38 passed through the pivot portion 29. The fixed potion 30 can be secured at a desired location along the elongated slot 39 by fastening a threaded bolt 40 passed through the fixed portion 30 of the AC generator 15 and the elongated slot 39. This arrangement allows the tension of the belt 37 to be adjusted to a desired tension by moving the position of the fixed portion 30 along the elongated slot 39, and hence the position of the driven pulley 36, and by securing the fixed portion 30 by tightening the threaded bolt 40.

The cantilever arms 32*a* and 32*b* are each provided with an extension 41*a* or 41*b* having a threaded hole. Each of the extensions 41*a* and 41*b* supports a corresponding part of the belt cover 16 by way of a rubber bush 42 interposed between the extension 41*a* or 41*b* and the belt cover 16, and is secured in position by a threaded bolt passed through the belt cover 16 and the rubber bush and threaded into the threaded hole of the extension 41*a* or 41*b*. Thus, these extensions 41*a* and 41*b* favorably support parts of the belt cover 16 which overhang from the profile of the engine 9. Thus, the belt cover 16 is supported at the parts 41*a* and 41*b* without interfering with the belt tensioning mechanism for the AC generator.

Although the AC generator 15 was located on a part opposing an end surface of the crankcase in the above described embodiment, it is possible to locate the AC generator at a part opposing a side of the crankcase or the cylinder block. Also, the belt cover was located on the upper end of the engine in the above described embodiment, but the present invention can additionally cover the arrangement having the belt cover on the lower end of the engine.

Although the present invention has been described in terms of a preferred embodiment thereof, it is obvious to a person skilled in the art that various alterations and modifications are possible without departing from the scope of the present invention which is set forth in the appended claims.

What we claim is:

1. An outboard marine engine, comprising:

an engine main body including a cylinder block, a crankcase, and a cylinder head;

a crankshaft extending out of one end of said engine main body in a vertical direction and carrying a drive pulley at a free end thereof;

an electric generator attached to said engine main body and having an input shaft extending in parallel with said crankshaft and carrying a driven pulley at a free end thereof projecting from said one end of said engine main body;

a belt passed around said drive and driven pulleys for transmission of power from said drive pulley to said driven pulley; and a belt cover covering at least part of said belt;

wherein said electric generator is mounted to said engine main body via a bracket, and said belt cover is at least partly secured to an extension of said bracket.

2. An outboard marine engine according to claim 1, wherein said bracket comprises first and second cantilever arms extending away from said engine main body for securing a pivoted portion and a fixed portion of said electric generator, and said belt cover is secured to extensions of said cantilever arms.

3. An outboard marine engine according to claim 2, wherein said first cantilever arm comprises vertically bifurcated end portions between which said pivoted portion of said electric generator is interposed in such a manner that said electric generator may be pivoted with respect to said engine main body via a bolt passed vertically through said bifurcated end portions of said first cantilever arm and said pivoted portion of said AC generator.

4. An outboard marine engine according to claim 3, wherein said second cantilever arm comprises an elongated slot defining an arc centered around said bolt passed vertically through said bifurcated end portions of said first cantilever arm so as to allow adjustment of the tension of said belt by moving said fixed portion along said second cantilever arm, and selectively securing said fixed portion with respect to said second arm at a desired tension of said belt.

5. An outboard marine engine according to claim 1, wherein said bracket is attached to a part of said crankcase defining a corner between a vertical surface and a horizontal surface.

6. An outboard marine engine according to claim 5, wherein said bracket is secured to said crankcase by at least one vertically oriented threaded bolts passed through said bracket and into said horizontal surface of said crankcase, and at least one horizontal threaded bolt passed through said bracket and into said vertical surface of said crankcase.

7. An outboard marine engine according to claim 5, wherein said vertical surface of said crankcase consists of an end surface of said engine main body.

8. An outboard marine engine according to claim 5, wherein said horizontal surface of said crankcase consists of an upper surface of said engine main body.

* * * * *